US006556657B1

(12) United States Patent
Tybinkowski et al.

(10) Patent No.: US 6,556,657 B1
(45) Date of Patent: Apr. 29, 2003

(54) X-RAY COLLIMATOR AND METHOD OF MANUFACTURING AN X-RAY COLLIMATOR

(75) Inventors: Andrew P. Tybinkowski, Boxford, MA (US); Ronald E. Swain, Reading, MA (US); Michael J. Duffy, Methuen, MA (US)

(73) Assignee: Analogic Corporation, Peabody, MA (US)

( * ) Notice: Subject to any disclaimer, the term of this patent is extended or adjusted under 35 U.S.C. 154(b) by 0 days.

(21) Appl. No.: 09/761,495

(22) Filed: Jan. 16, 2001

Related U.S. Application Data

(60) Provisional application No. 60/225,808, filed on Aug. 16, 2000.

(51) Int. Cl.[7] ..... G21K 1/02
(52) U.S. Cl. ..... 378/147; 378/149
(58) Field of Search ..... 378/147, 149, 378/145, 16

(56) References Cited

U.S. PATENT DOCUMENTS

| | | | | |
|---|---|---|---|---|
| 4,125,776 A | | 11/1978 | Tosswill et al. | |
| 4,277,685 A | | 7/1981 | Covic et al. | 250/445 |
| 4,466,112 A | | 8/1984 | Covic et al. | 378/7 |
| 4,920,552 A | | 4/1990 | Hermens | 378/153 |
| 4,991,189 A | | 2/1991 | Boomgaarden et al. | 378/4 |
| 5,293,417 A | * | 3/1994 | Wei et al. | 378/147 |
| 5,299,250 A | | 3/1994 | Styrnol et al. | 378/19 |
| 5,303,282 A | | 4/1994 | Kwasnick et al. | |
| 5,432,834 A | * | 7/1995 | Gershman | 378/55 |
| 5,524,041 A | | 6/1996 | Grenier | 378/147 |
| 5,550,886 A | | 8/1996 | Dobbs et al. | 378/19 |
| 5,563,924 A | | 10/1996 | Winkelmann | 378/150 |
| 5,644,614 A | | 7/1997 | Toth et al. | 378/147 |
| 5,684,854 A | | 11/1997 | Hughes | 378/206 |
| 5,799,057 A | | 8/1998 | Hoffman et al. | 378/147 |
| 6,327,328 B1 | * | 12/2001 | Satoh et al. | 378/17 |

OTHER PUBLICATIONS

England, Gordon, Combustion Wire Thermal Spray Process (Metal Spraying or Flame Spray), Aug. 3, 2000, http://homepage.dtn.ntl.com/gordon.england/cws.htm.

England, Gordon, HVOF High Velocity Oxygen Fuel Thermal Spray Process, Aug. 3, 2000, http://homepage.dtn.ntl-.com/gordon.england/hvof.htm.

* cited by examiner

*Primary Examiner*—Drew A. Dunn
(74) *Attorney, Agent, or Firm*—McDermott, Will & Emery

(57) ABSTRACT

A method of manufacturing a collimator including providing a plate-like body, coating a predetermined portion of a surface of the body with an x-ray absorbing material, and machining at least one collimating slit through the coating and the plate-like body. According to one exemplary embodiment, the coating is applied through a thermal spray process. According to another exemplary embodiment, wire electrical discharge machining (EDM) is used to machine the collimating slits. A collimator manufactured in accordance with the presently disclosed method produces precise energy beam cross-sections, yet is less expensive to manufacture.

12 Claims, 3 Drawing Sheets

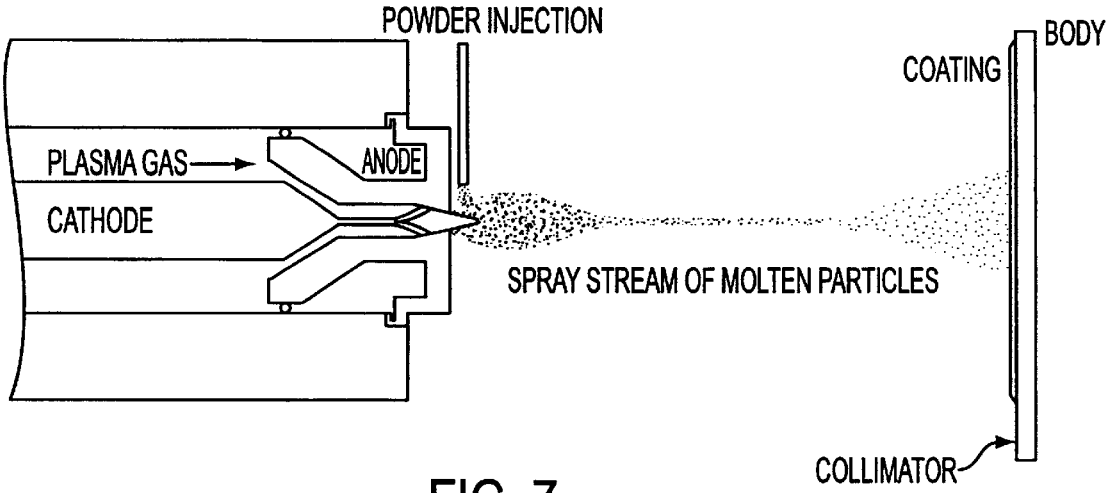
FIG. 7
FIG. 8A
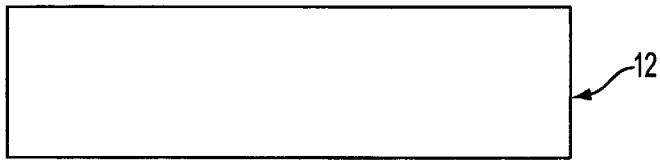
FIG. 8B
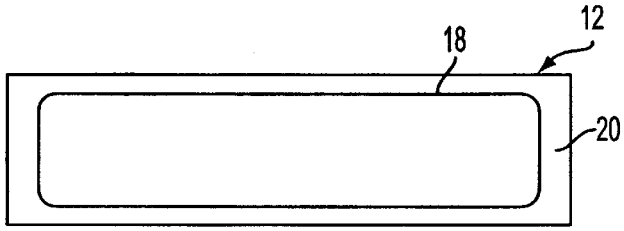
FIG. 8C
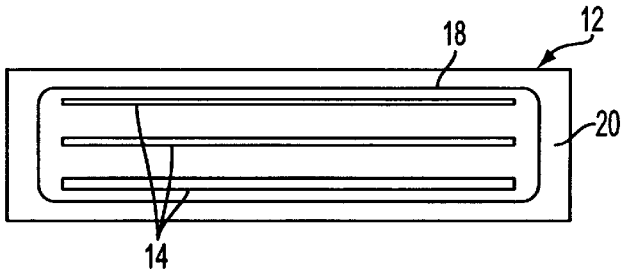
FIG. 8D
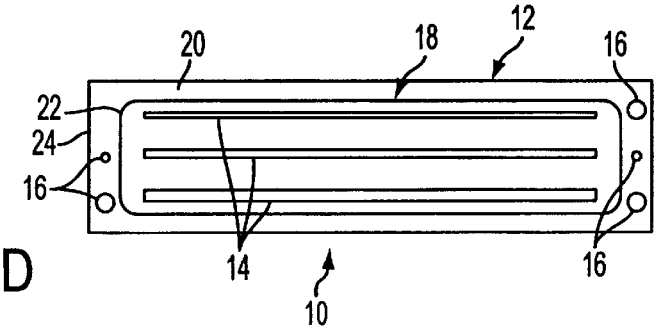

X-RAY COLLIMATOR AND METHOD OF MANUFACTURING AN X-RAY COLLIMATOR

CROSS-REFERENCE TO RELATED APPLICATION

The present application claims priority to provisional U.S. patent application Serial No. 60/225,808 filed on Aug. 16, 2000, which is assigned to the assignee of the present application and incorporated herein by reference.

FIELD OF DISCLOSURE

The present disclosure relates to the field of radiography and, in particular, relates to computer tomography scanners. Even more particularly, the present disclosure relates to an x-ray collimator for use as part of a computer tomography scanner, and a method of manufacturing an x-ray collimator.

BACKGROUND OF DISCLOSURE

In computed tomography, a patient to be examined is positioned in a scan circle of a computer tomography (CT) scanner. A shaped x-ray beam is then projected from an x-ray source through the scan circle and the patient, to an array of radiation detectors. By rotating the x-ray source and the collimator relative to the patient (about a z-axis of the scanner), radiation is projected through an imaged portion of the patient to the detectors from a multiplicity of directions. From data provided by the detectors, an image of the scanned portion of the patient is constructed.

Within the x-ray source, an electron beam strikes a focal spot point or line on an anode, and x-rays are generated at the focal spot and emitted along diverging linear paths in an x-ray beam. A collimator is employed for shaping a cross-section of the x-ray beam, and for directing the shaped beam through the patient and toward the detector array.

Conventional collimators generally comprise a plate of material that attenuates or absorbs x-rays, such as a lead alloy, tungsten or a tungsten carbide. The plate is provided with one or more slits for shaping cross-sections of x-ray beams. Dimensions of the slits must adhere to tight tolerances to produce precise beam cross-sections.

If the collimator is made of a very hard material, such as tungsten or a tungsten carbide, then expensive machining methods such as wire electrical discharge machining must be used to manufacture the collimator.

What is desired, therefore, is a collimator that produces precise beam cross-sections, yet that is less expensive to manufacture.

SUMMARY OF THE DISCLOSURE

The present disclosure, accordingly, is directed to a collimator and a method of manufacturing a collimator that address and overcome the limitations of conventional collimators. In particular, the present disclosure provides a collimator for collimating a beam of energy. The collimator includes a plate-like body, a coating of x-ray absorbing material covering a predetermined portion of a surface of the body, and at least one slit for collimating the emitted beam, with the slit extending through the coating and the body.

The present disclosure also provides a method of manufacturing a collimator. The method includes providing a plate-like body, and coating a predetermined portion of a surface of the body with an x-ray absorbing material. The method also includes machining at least one collimating slit through the coating and the plate-like body.

A collimator constructed in accordance with the present disclosure produces precise beam cross-sections, yet is less expensive to manufacture.

BRIEF DESCRIPTION OF DRAWINGS

The foregoing and other features and advantages of the present disclosure will become more apparent from the following detailed description of the disclosure, as illustrated in the accompanying drawing figures wherein:

FIG. 7 is a schematic view illustrating a coating process used in accordance with the present disclosure to manufacture the collimator of FIG. 3; and FIGS. 8A, 8B, 8C and 8D are top plan views progressively illustrating a method according to the present disclosure of manufacturing the collimator of FIG. 3.

DETAILED DESCRIPTION OF DISCLOSURE

Figure 1:
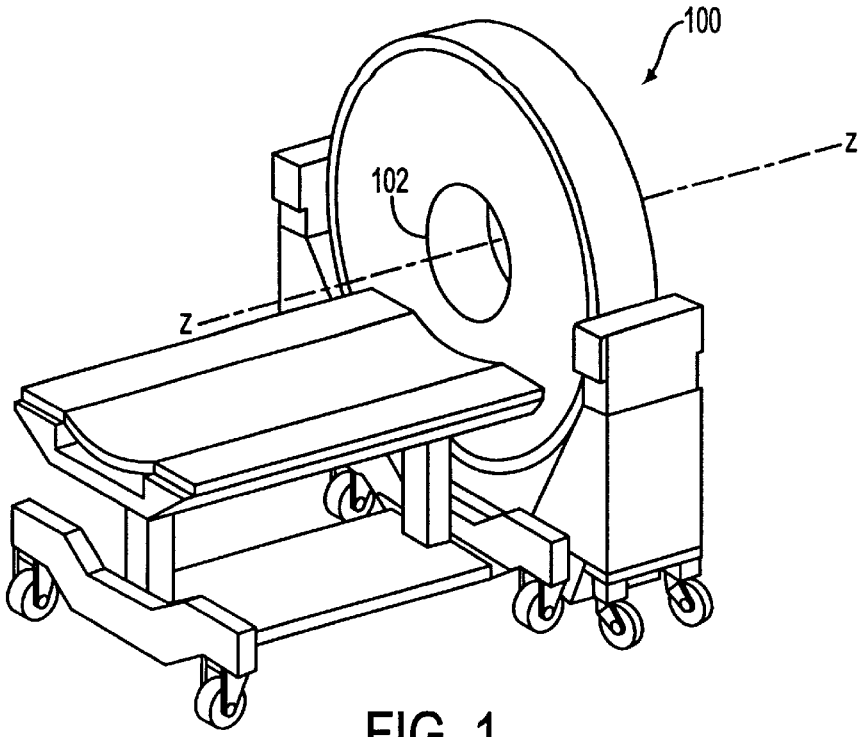
FIG. 1 is a perspective view of an exemplary CT scanner including a collimator assembly having a collimator constructed in accordance with the present invention.
Figure 2:
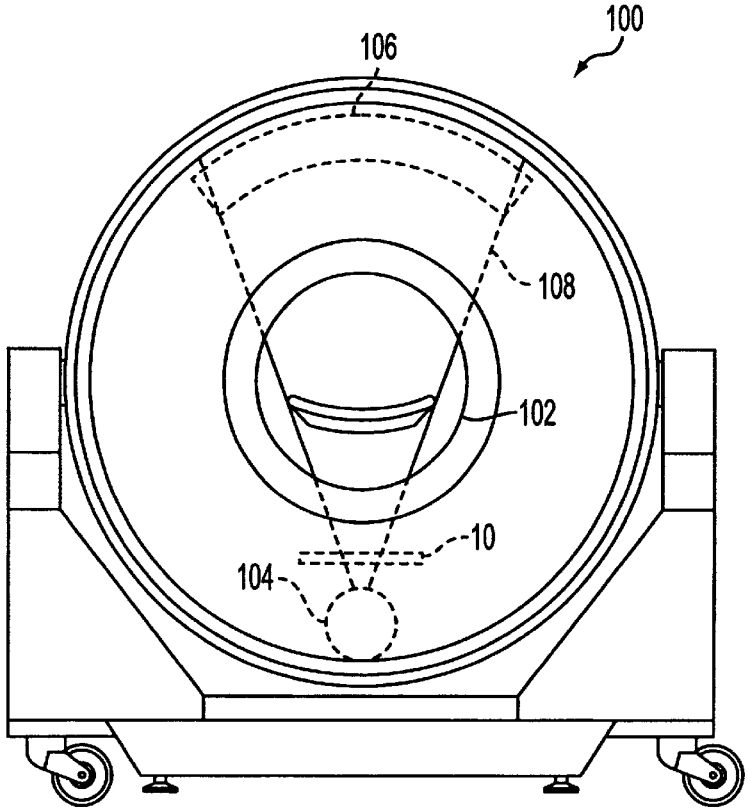
FIG. 2 is a front elevation view of the CT scanner of FIG. 1.

Referring first to FIGS. 1 and 2, in computed tomography, a patient (not shown) to be examined is positioned in a scan circle 102 of a computer tomography (CT) scanner 100, parallel with a z-axis, and between an x-ray source 104 and a rectangular detector array 106. The x-ray source then projects a beam of energy, or x-rays 108, through the patient, to the detector array. By rotating the x-ray source about the z-axis and relative to the patient, radiation is projected through a portion of the patient to the detector array from a many different directions around the patient. An image of the scanned portion of the patient then is constructed from data provided by the detector array.

The scanner 100 of FIGS. 1 and 2 employs a collimator 10 for shaping the cross-section of the beam 108 into a rectangular shape that matches the rectangular detector array 106. The collimator 10 ensures that only a preferred row of the detector array 106 is irradiated by the beam 108 and so that a patient being scanned is not subjected to an unnecessary dose of x-rays.

Figure 3:
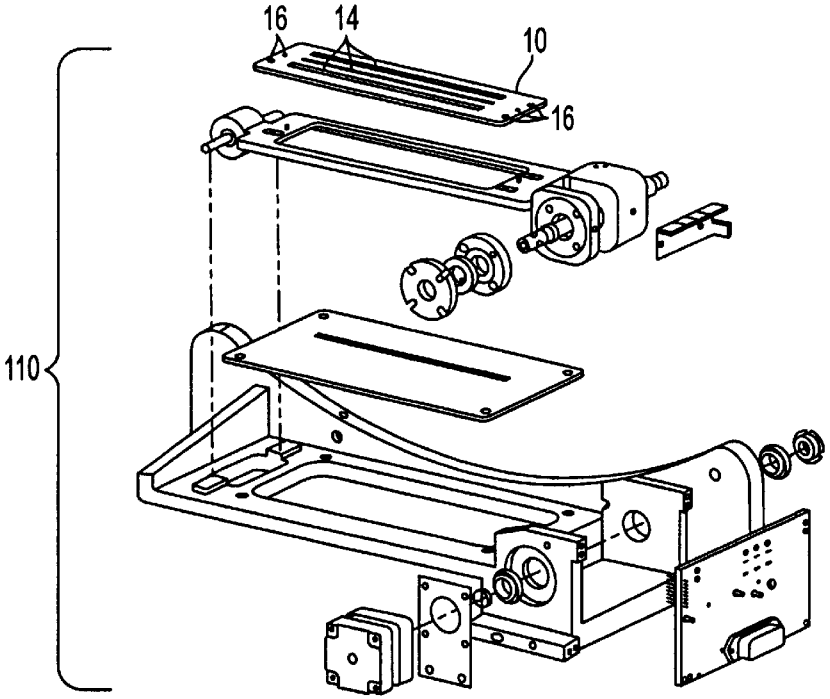
FIG. 3 is an exploded perspective view of the collimator assembly and collimator of the CT scanner of FIG. 1.

Referring also to FIG. 3, the collimator 10 includes a plate-like body 12 defining at least one elongated slit 14 for allowing the x-ray beam to pass through the slit and be shaped by the collimator. As shown, the collimator 10 can be provided with a plurality of slits 14 of varied, but uniform widths, and the collimator can be included as part of an assembly 110 that allows for the. selection of one of the collimator slits 14 such that a desired beam width can be produced by the collimator 10. Details of the assembly 110 are disclosed in co-pending U.S. patent application Ser. No. 09/552,141, filed Apr. 19, 2000, now U.S. Pat. No. 6,301, 334 issued Oct. 9, 2001, which is assigned to the assignee of the present application and incorporated into the present application by reference. As shown in FIG. 3, the collimator 10 also includes various mounting apertures 16 formed in the plate-like body 12 for mounting the collimator to the assembly 110.

Figure 5:
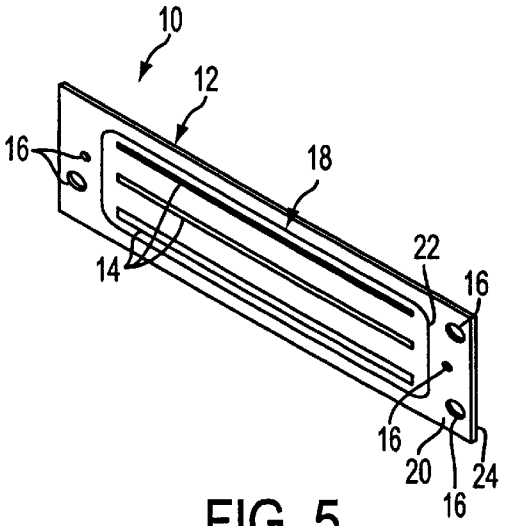
FIGS. 4, 5 and 6 are side elevation, perspective, and top plan views, respectively, of the collimator of FIG. 3.
Figure 6:
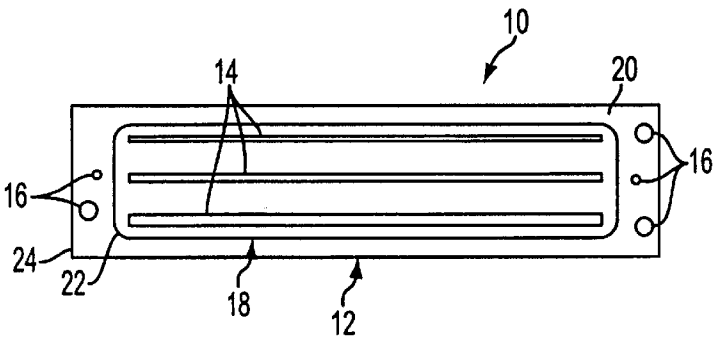
Figure 4:
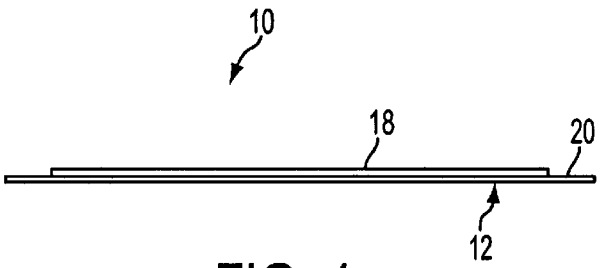

Referring also to FIGS. 4 through 6, the collimator 10 also includes a coating 18 covering a predetermined portion of a top surface 20 of the plate-like body 12. The coating 18 surrounds the collimating slits 14 and is comprised of an x-ray attenuating or absorbing material such a tungsten carbide. The plate-like body 12 is made of a suitable noncorrosive, more easily machined material such as stainless steel, aluminum or brass. As an example of a preferred embodiment of a collimator 10 constructed in accordance with the present disclosure, the plate-like body 12 is provided with a thickness of about 60/100 of an inch, while the coating 18 is provided with a thickness of at least about 1 millimeter.

Referring to FIG. 7, a preferred method of applying the coating 18 is through a thermal spray process. For tungsten carbide an appropriate method is a plasma thermal spray process, which is basically the spraying of molten or heat softened tungsten carbide onto the top surface of the plate-like body to provide the coating. As shown, tungsten carbide in the form of powder is injected into a very high temperature plasma flame, where it is rapidly heated and accelerated to a high velocity. The hot tungsten carbide impacts on the surface of the plate-like body 12 and rapidly cools to form the coating 18. This process carried out correctly is called a "cold process" as the temperature of the plate-like body 12 can be kept low during processing thereby avoiding damage, metallurgical changes and distortion to the body.

The plasma gun comprises a copper anode and tungsten cathode, both of which are water cooled. Plasma gas (argon, nitrogen, hydrogen, helium) flows around the cathode and through the anode which is shaped as a constricting nozzle. The plasma is initiated by a high voltage discharge which causes localized ionization and a conductive path for a DC arc to form between cathode and anode. The resistance heating from the arc causes the gas to reach extreme temperatures, dissociate and ionize to form a plasma. The plasma exits the anode nozzle as a free or neutral plasma flame (plasma which does not carry electric current). When the plasma is stabilized ready for spraying the electric arc extends down the nozzle, instead of shorting out to the nearest edge of the anode nozzle. This stretching of the arc is due to a thermal pinch effect. Cold gas around the surface of the water cooled anode nozzle being electrically non-conductive constricts the plasma arc, raising its temperature and velocity. Tungsten carbide powder is then fed into the plasma flame most commonly via an external powder port mounted near the anode nozzle exit. The powder is so rapidly heated and accelerated that spray distances can be in the order of 25 to 150 mm.

The plasma thermal spray process is most commonly used in normal atmospheric conditions. Plasma spraying has the advantage that it can spray very high melting point materials such as refractory metals like tungsten, and plasma sprayed coatings are generally much denser, stronger and cleaner than the other thermal spray processes.

Referring to FIGS. 8A through 8D, a method according to the present disclosure of manufacturing the collimator 10 of FIG. 3 is progressively illustrated. As shown first in FIGS. 8A and 8B, the coating 18 is applied to a predetermined portion of the top surface 20 of the plate-like body 12 of the collimator 10. The collimating slits 14 are then machined through the coating 18 and the plate-like body 12 as illustrated in FIG. 8C.

Preferably, wire electrical discharge machining (EDM) is used to machine the collimating slits 14. Wire EDM is a machining process for cutting metals using a thin wire electrode. Although not shown, electrical sparks between the metal collimator 10 and the thin wire electrode melts thin line-like portions of the coating 18 and the plate-like body 12 to form the collimating slits 14. Wire EDM is a preferred method since it can make high precision cuts on any conductive materials, can be as accurate as +/−0.0001 inches, and is ideal for precision and delicate cutting—as is required for x-ray collimating slits.

Referring to FIG. 8D, after the collimating slits 14 are machined, the mounting apertures 16 are machined in the plate-like body 12 between an outer periphery 22 of the coating 18 and an outer periphery 24 of the body 12 using a less expensive method of machining.

While this disclosure has been particularly shown and described with references to the collimator of FIGS. 3–8, it will be understood by those skilled in the art that various changes in form and in details may be made thereto without departing from the spirit and scope of the disclosure as defined by the appended claims. For example, the novel features of a collimator as disclosed herein can be applied to a collimator having a single collimating slit, a curved collimator, or a post-patient collimator. In addition, the coating can comprise a suitable material other than tungsten carbide for attenuating and absorbing x-rays, such as a lead alloy. And the method of applying the coating is not limited to a plasma thermal spray process.

What is claimed is:

1. A method of manufacturing a collimator comprising:

providing a plate-like body;

coating a predetermined portion of a surface of the body with an x-ray attenuating material; and machining at least one collimating slit through the coating and the plate-like body.

2. A method according to claim 1, further comprising machining mounting apertures in the plate-like body between an outer periphery of the coating and an outer periphery of the body.

3. A method according to claim 1, wherein the coating is provided using a thermal spray process.

4. A method according to claim 3, wherein the coating is provided using a plasma thermal spray process.

5. A method according to claim 1, wherein the collimating slit is provided using a wire EDM process.

6. A collimater manufactured by a method according to claim 1.

7. A method of manufacturing a collimator comprising:

providing a plate-like body;

coating a predetermined portion of a surface of the body with an x-ray absorbing material; and machining at least one collimating slit through the coating and the plate-like body.

8. A method according to claim 7, further comprising machining mounting apertures in the plate-like body between an outer periphery of the coating and an outer periphery of the body.

9. A method according to claim 7, wherein the coating is provided using a thermal spray process.

10. A method according to claim 9, wherein the coating is provided using a plasma thermal spray process.

11. A method according to claim 7, wherein the collimating slit is provided using a wire EDM process.

12. A collimater manufactured by a method according to claim 7.

* * * * *